US011518479B2

(12) United States Patent
Menon

(10) Patent No.: US 11,518,479 B2
(45) Date of Patent: Dec. 6, 2022

(54) PARTIALLY FIXED TWEEN DECKS

(71) Applicant: Govind Prasad Menon, Houston, TX (US)

(72) Inventor: Govind Prasad Menon, Houston, TX (US)

( * ) Notice: Subject to any disclaimer, the term of this patent is extended or adjusted under 35 U.S.C. 154(b) by 84 days.

(21) Appl. No.: 17/313,151

(22) Filed: May 6, 2021

(65) Prior Publication Data

US 2022/0355903 A1 Nov. 10, 2022

(51) Int. Cl.
*B63B 11/02* (2006.01)

(52) U.S. Cl.
CPC ..... *B63B 11/02* (2013.01)

(58) Field of Classification Search
CPC ..... B63B 11/00; B63B 11/02
USPC ..... 114/116, 65 R, 72, 73, 77 R, 77 A, 85
See application file for complete search history.

(56) References Cited

U.S. PATENT DOCUMENTS 1,114,263 A * 10/1914 Horne ..... B63B 3/52 114/65 R
3,019,757 A * 2/1962 Bailey ..... B63B 25/18 114/72
3,038,432 A * 6/1962 Goldman ..... B63B 19/14 114/72
3,348,515 A * 10/1967 Campbell ..... B63B 25/00 114/72
3,386,405 A * 6/1968 Knight, Jr. ..... B63B 25/20 414/143.2
3,970,026 A * 7/1976 Burton ..... B63B 25/18 114/85
4,130,075 A * 12/1978 Larive ..... B63B 25/18 105/370

* cited by examiner

*Primary Examiner* — Daniel V Venne
(74) *Attorney, Agent, or Firm* — David W Barman

(57) ABSTRACT

An apparatus, vessel and method for forming a tween deck within the cargo hold of the vessel that comprises at least one fixed tween deck permanently secured to the interior of the vessel, an opening extending through the at least one fixed tween deck and at least one portable tween deck sized to be received within the opening so as to form a completed tween deck with the at least one fixed tween deck.

8 Claims, 5 Drawing Sheets

PARTIALLY FIXED TWEEN DECKS

BACKGROUND

1. Technical Field

This disclosure relates generally to cargo shipping and in particular to a method and apparatus for providing flexible tween decks.

2. Description of Related Art

Marine cargo transportation is one of the most commonly used shipping methods in the world today. Much of the materials that are shipped are done so on a bulk carrier. Bulk carriers commonly include a cargo hold, or contained region inside the hull of the vessel formed between the main deck and the bottom of the hull. One difficulty in such cargo holds is that they are frequently large open areas in the ship having a common compartment. In order to increase the carrying flexibility of the cargo hold, intermediate decks are sometimes located between the main deck and the bottom of the hull to provide an intermediate deck on which to locate cargo. Such intermediate decks are commonly referred to as tween decks. One current limitation of conventional tween decks is that they are frequently a simple deck structure that is supported within or otherwise temporarily secured to the wall of the cargo hold.

SUMMARY OF THE DISCLOSURE

According to a first embodiment, there is disclosed an apparatus for supporting loads in a marine vessel comprising at least one fixed tween deck permanently secured to the interior of the vessel, an opening extending through the at least one fixed tween deck and at least one portable tween deck sized to be received within the opening so as to form a completed tween deck with the at least one fixed tween deck.

The apparatus may further comprise at least one support for supporting the at least one portable tween deck. The at least one support may comprise an upright. The at least one support may comprise a retractable members selectably extendable from a sidewall of the cargo hold.

The fixed tween deck may extend between sides of the hull wherein the portable tween deck is located between two fixed deck portions. Each opening may be sized to receive at least two portable tween decks therein.

According to a further embodiment, there is disclosed a cargo vessel comprising a hull, a cargo hold sized to receive cargo defined by an interior wall, at least one fixed tween deck permanently secured to the interior of the vessel, an opening extending through the at least one fixed tween deck and at least one portable tween deck sized to be received within the opening so as to form a completed tween deck with the at least one fixed tween deck.

According to a further embodiment, there is disclosed a method for providing load supports in a marine vessel comprising permanently securing at least one fixed tween deck to the interior of the vessel wherein the fixed tween deck has an opening extending therethrough and selectably locating at least one portable tween deck within the opening so as to form a completed tween deck with the at least one fixed tween deck.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Figure 1:
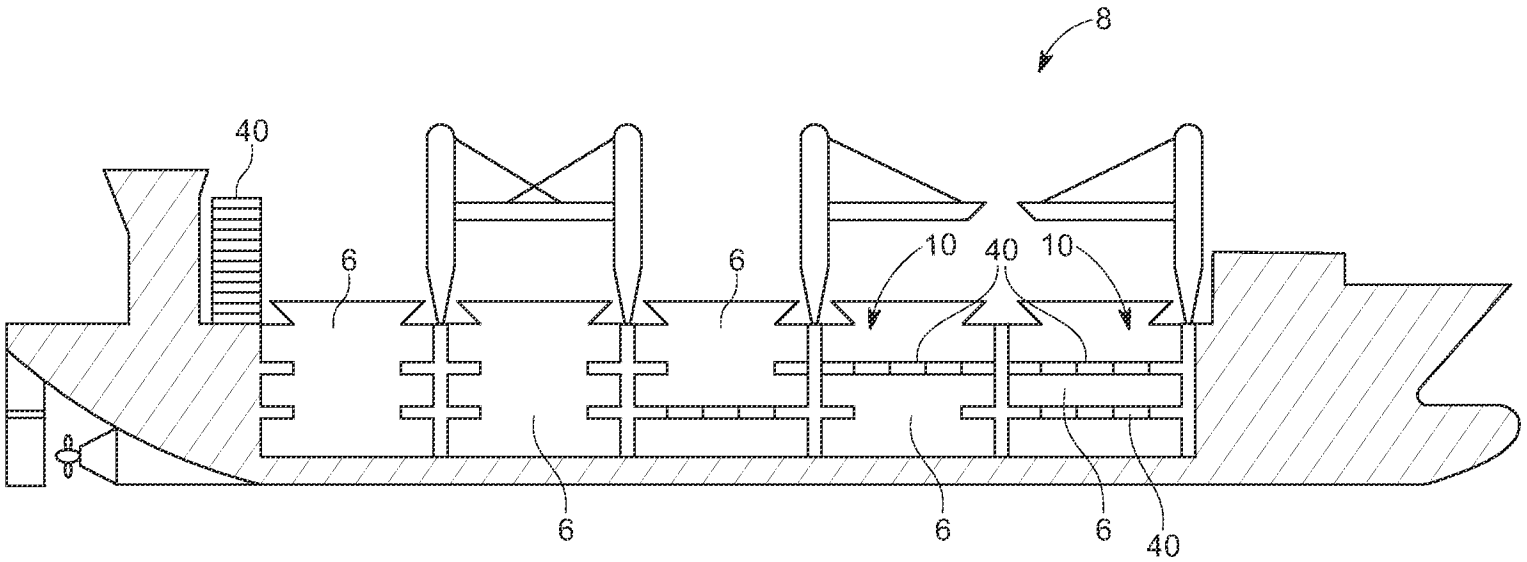
FIG. 1 is a cross sectional view of a cargo ship according to a first embodiment of the present disclosure.

Aspects of the present disclosure are now described with reference to exemplary apparatuses, methods and systems. Referring to FIG. 1, an exemplary apparatus for forming a load supporting deck in a marine vessel 8 according to a first embodiment is shown generally at 10. The apparatus comprises at least one fixed tween deck 12 spanning the cargo hold 6 of the vessel at a desired height and one or more portable tween decks 40 located proximate to the fixed tween decks so as to form a continuous tween deck therewith. In the present description, the marine vessel 8 may be selected to be a bulk carrier although other vessel types may incorporate the present design as well.

Figure 2:
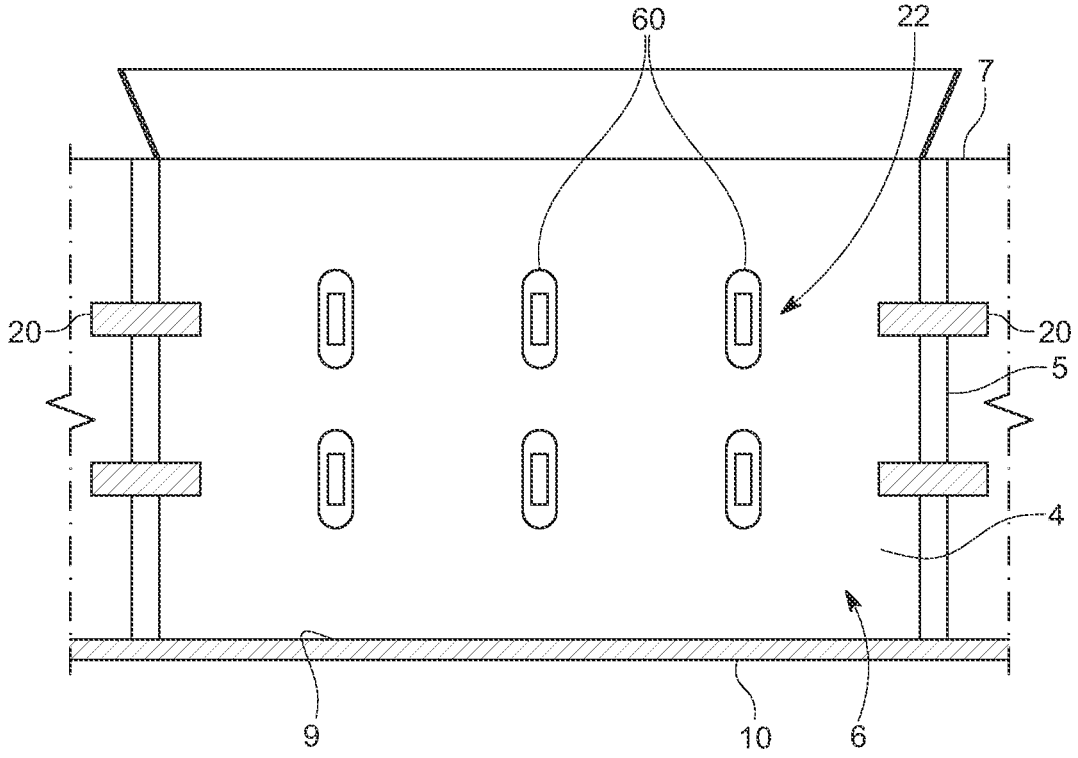
FIG. 2 is a detailed cross sectional view of the vessel of FIG. 1 with a openings between the fixed tween decks.
Figure 5:
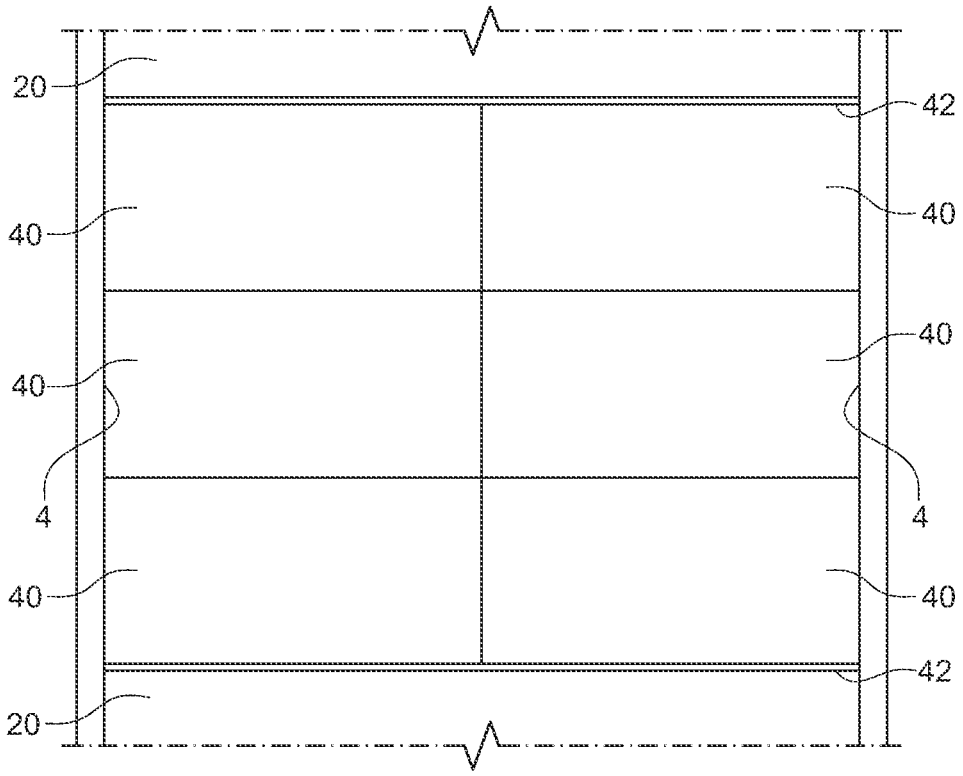
FIG. 5 is a top plan view of the tween decks located between the fixed decks of the vessel of FIG. 1.

Turning now to FIG. 2, one section of the vessel 8 and in particular a cargo hold 6 is illustrated. The cargo hold 6 extends between the bottom of hull 9 and the main deck 7 of the vessel and may be separated or defined between bulkheads 5 or other reinforcing or framing structure. The cargo hold 6 may include sidewalls 4 proximate to the sides of the hull as are known. The cargo hold includes one or more fixed tween decks 20 which are permanently secured to the bulkhead and/or the sidewalls 4 of the vessel. The fixed tween decks 20 are not removable but are instead secured to the hull of the vessel in a fixed location by any suitable means including welding, fasteners, or the like. The fixed decks 20 may be formed of any construction manner as are commonly known and form an opening 22 therebetween within the cargo hold. The opening 22, as illustrated in FIG. 5 may span the width of the cargo hold 6 between the sidewalls 4 of the hull. Furthermore as illustrated in FIG. 5, the opening 22 spans between two successive fixed tween decks 20.

Figure 3:
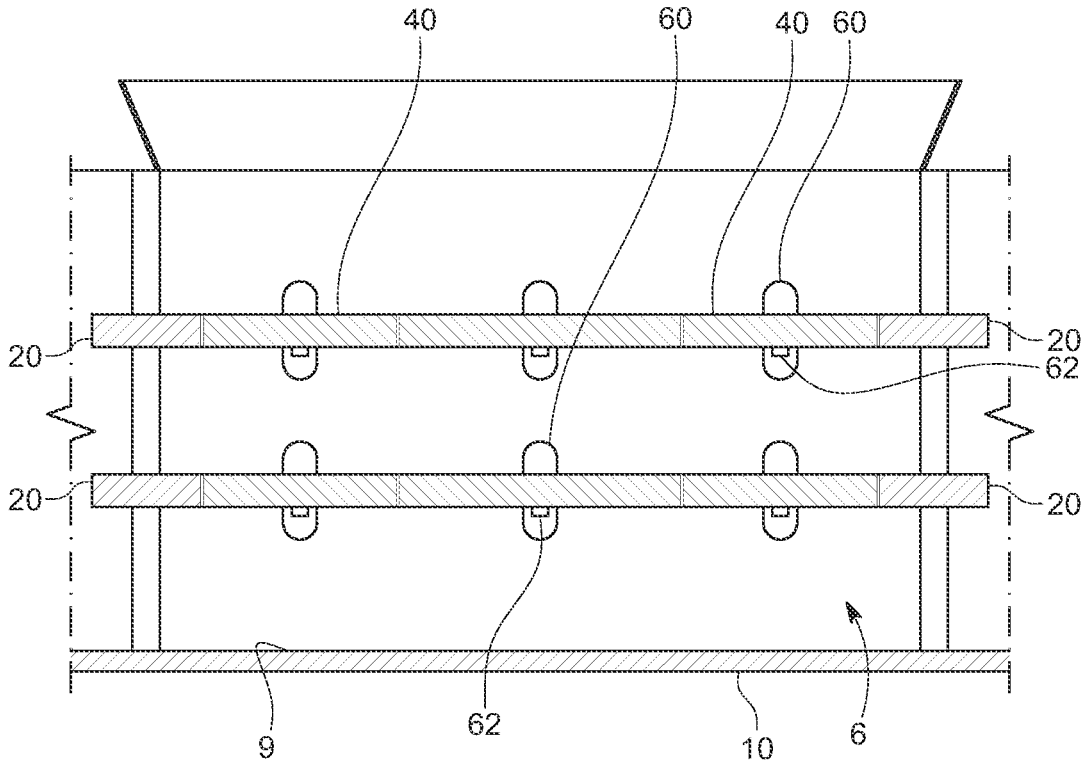
FIG. 3 is a detailed cross sectional view of the vessel of FIG. 1 with a portable tween deck located between the fixed tween decks.

Turning now to FIG. 3, the portable tween decks 40 are located within the opening 22 between the fixed tween decks 20 so as to form a continuous deck therewith. The portable tween decks 40 comprise substantially planar members and may be of any suitable construction. As illustrated in FIG. 5, the portable tween decks 40 may be sized to be located within the opening. In particular, the portable tween decks 40 may be sized such that a desired plurality of portable tween decks are located within the sidewalls 4 of the hull and the fixed tween decks 20. In particular, as illustrated in FIG. 5, the opening 22 and portable tween decks 40 may be sized such that 2 portable tween decks span the opening in a transverse direction and 3 portable tween decks span the opening between the fixed tween decks although other quantities in each direction may also be utilized. Furthermore as illustrated in FIG. 5, a gap 42 may be formed between the portable tween deck 40 and the fixed tween deck 20. In practice it has been found that a gap distance of up to 10 inches (254 mm) may be useful.

Figure 4:
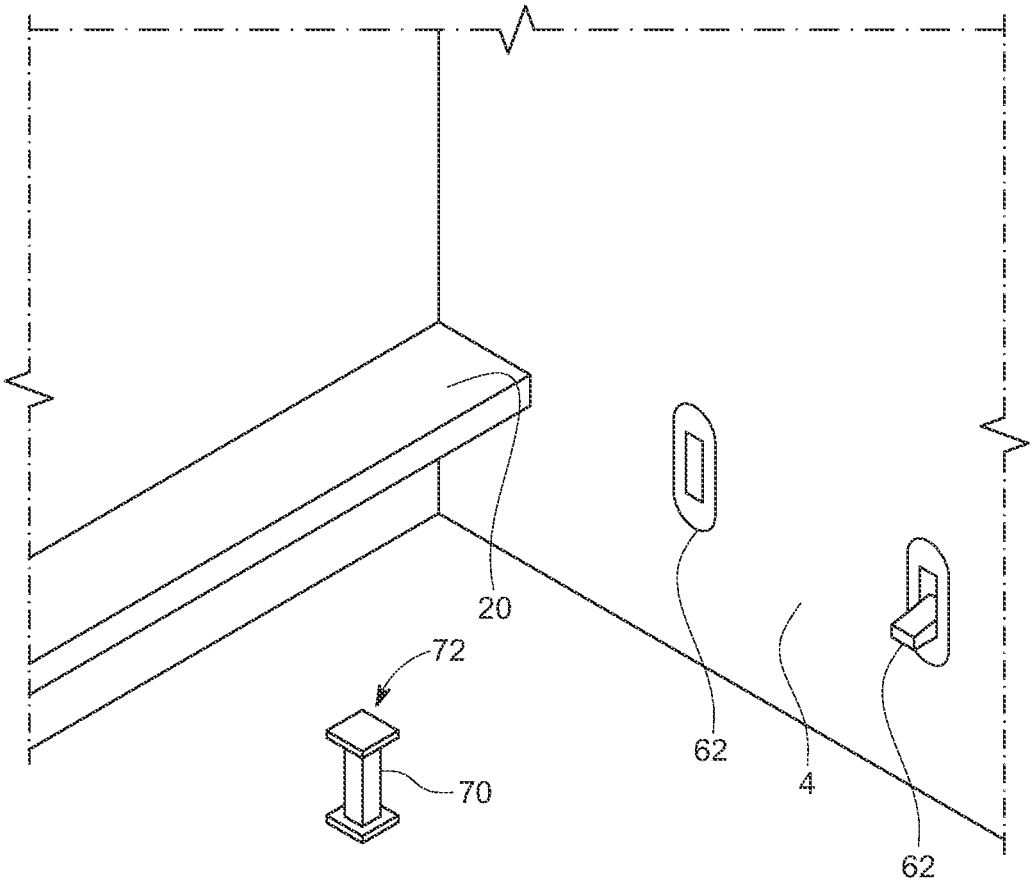
FIG. 4 is a detailed perspective view of a retractable support and support structure for supporting the portable tween deck.

Turning to FIG. 4, the portable tween decks 40 may be supported within the opening 22 through the use of consoles 60 formed in the sidewalls 4 of the vessel or stools 70 or other upright support structure. The console 60 as are known may include a rotatable member 62 therein adapted to be rotated outward from the console 60 to form a support shelf for the portable tween decks 40.

In operation, the portable tween decks 40 may be located within the openings 22 as set out above to form a continuous deck surface. Such additional deck surfaces increase the storage deck space of the vessel permitting a greater amount of cargo to be located thereon and therefore transported by the vessel 8. When not in use, the portable tween decks 40 may be removed from the openings 22 and stored in any other location such as on the top of the main deck 7 as illustrated in FIG. 1. As illustrated, the vessel 8 may incorporate one or more tween decks formed by the fixed tween decks and the portable tween decks. It will be furthermore appreciated that the fixed tween decks 20 may be located at more than one location in the cargo hold 6 wherein the portable tween decks 40 may be included in one location or omitted in another to provide greater flexibility in the location of the completed tween decks. It will also be appreciated that the fixed and portable tween decks 20 and 40, when included within a bulk carrier permit the bulk carrier to be converted from a bulk carrier to a deck carrier. The inclusion of the fixed tween decks 20 (even with out the use of the portable tween decks 40) may also server to increase the safety for workers on the vessel by providing additional footing space for access to the cargo hold and will also increase the storage deck space of the vessel.

While specific embodiments have been described and illustrated, such embodiments should be considered illustrative only and not as limiting the disclosure as construed in accordance with the accompanying claims.

What is claimed is:

1. A partially fixed tween deck apparatus for supporting loads in a marine vessel comprising:

at least one fixed tween deck permanently secured to an interior wall of the vessel;

an opening extending through the at least one fixed tween deck; and at least one portable tween deck sized to be received within the opening so as to form a completed tween deck with the at least one fixed tween deck.

2. The apparatus of claim 1 further comprising at least one support for supporting the at least one portable tween deck.

3. The apparatus of claim 2 wherein the at least one support comprises an upright.

4. The apparatus of claim 2 wherein the at least one support comprises a retractable members selectably extendable from a sidewall of the cargo hold.

5. The apparatus of claim 1 wherein the fixed tween deck extends between sides of the hull wherein the portable tween deck is located between two fixed deck portions.

6. The apparatus of claim 1 wherein each opening is sized to receive at least two portable tween decks therein.

7. A cargo vessel comprising:

a hull;

a cargo hold sized to receive cargo defined by an interior wall;

at least one fixed tween deck permanently secured to said interior wall;

an opening extending through the at least one fixed tween deck;

at least one portable tween deck sized to be received within the opening so as to form a completed tween deck with the at least one fixed tween deck.

8. A method for providing load supports in a marine vessel comprising:

permanently securing at least one fixed tween deck to an interior wall of said vessel wherein the fixed tween deck has an opening extending therethrough;

selectably locating at least one portable tween deck within the opening so as to form a completed tween deck with the at least one fixed tween deck.

* * * * *